US009147957B2

(12) United States Patent
Randolph et al.

(10) Patent No.: US 9,147,957 B2
(45) Date of Patent: Sep. 29, 2015

(54) ELECTRICAL CONNECTOR WITH TERMINAL POSITION ASSURANCE

(71) Applicant: Tyco Electronics Corporation, Berwyn, PA (US)

(72) Inventors: Kurt Allan Randolph, Ellers, PA (US); Jeffrey Richard Ruth, Middletown, PA (US); Richard Benjamin Emenheiser, Mount Joy, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/155,180

(22) Filed: Jan. 14, 2014

(65) Prior Publication Data

US 2015/0200484 A1 Jul. 16, 2015

(51) Int. Cl.

| | |
|---|---|
| ***H01R 13/514*** | (2006.01) |
| ***H01R 13/424*** | (2006.01) |
| ***H01R 24/20*** | (2011.01) |

(52) U.S. Cl.

CPC ..... *H01R 13/424* (2013.01); *H01R 24/20* (2013.01); *H01R 13/514* (2013.01)

(58) Field of Classification Search

CPC ..... H01R 13/631; H01R 13/514

USPC ..... 439/686, 660, 874, 752, 607.01, 374, 439/668, 685, 472, 470, 680, 358, 282

See application file for complete search history.

(56) References Cited

U.S. PATENT DOCUMENTS

| | | | | |
|---|---|---|---|---|
| 4,655,525 | A * | 4/1987 | Hunt et al. | 439/599 |
| 4,984,998 | A | 1/1991 | Duncan et al. | |
| 6,173,488 | B1 | 1/2001 | Endo et al. | |
| 6,350,159 | B1 * | 2/2002 | Wu | 439/680 |
| 2009/0186507 | A1 * | 7/2009 | Watanabe et al. | 439/282 |
| 2010/0178790 | A1 * | 7/2010 | Bright et al. | 439/346 |

FOREIGN PATENT DOCUMENTS

| | | | |
|---|---|---|---|
| EP | 0591950 | A2 | 4/1994 |
| FR | 2584539 | A1 | 1/1987 |
| WO | 8807775 | A1 | 10/1988 |
| WO | 9528021 | A1 | 10/1995 |

OTHER PUBLICATIONS

International Search Report, International Application No. PCT/US2014/069696, International Filing Date Dec. 11, 2014.

* cited by examiner

*Primary Examiner* — Abdullah Riyami
*Assistant Examiner* — Nader J Alhawamdeh

(57) ABSTRACT

An electrical connector is provided that includes a housing, terminals, and a stuffer. The housing has a plurality of terminal channels extending from a rear to a front of the housing. The front of the housing is configured to interface with a mating connector. The terminals are loaded into corresponding terminal channels from the rear of the housing. The terminals extend along a terminal axis between a mating end and a terminating end. The terminating end includes at least one tab that protrudes radially outward from the terminal axis. The stuffer is coupled to the rear of the housing. The stuffer includes multiple teeth received in corresponding terminal channels. When one terminal is not fully loaded in the terminal channel, the corresponding tooth engages one or more of the at least one tab of the terminal and forces the terminal further into the terminal channel.

20 Claims, 4 Drawing Sheets

ELECTRICAL CONNECTOR WITH TERMINAL POSITION ASSURANCE

BACKGROUND OF THE INVENTION

The subject matter herein relates generally to electrical connectors with terminal position assurance devices.

Some electrical connectors are designed for multi-pin connections. The electrical connectors may be mated to mating connectors terminated to wires or mounted on circuit boards. Such multi-pin connectors are generally assembled by coupling terminals to wires, then loading the terminals into a cavity in a connector housing. Generally, there is a retention feature on the terminal and/or in the cavity that is engaged once a terminal reaches a designated position within the length of the cavity in order to prevent the terminal from backing out of the cavity unintentionally during use of the connector. Sometimes the retention feature fails to prevent the terminal from exiting the cavity, such as if the retention feature is dysfunctional or the terminal was not inserted far enough into the cavity to properly engage the retention feature. If a terminal is not properly retained within a cavity, when the electrical connector is mated to a mating connector, a corresponding mating contact may not connect properly to the subject terminal. For example, the incoming mating contact may drive the terminal back out of the housing, preventing a proper electrical connection between the terminal and the mating contact. Each housing may hold up to twenty or more terminals, and even a single missed electrical connection may compromise the functionality of the entire connector system and the devices they connect.

Electrical connectors in the art may attempt to prevent terminals from unintentional movement in the cavities by adding a restraining device. For example, a device may be added to a rear of the housing that is configured to act as a barrier and/or push any terminals that are not at the designated position further into the respective cavities towards the designated position. However, such devices have various problems. For example, the terminals may be terminated to insulated wires that extend from the rear of the housing and make it difficult to access the terminals (e.g., to push and/or block rearward movement of the terminals), especially when the terminals are grouped into multiple columns and/or rows. A restraining device may not be able to be installed between adjacent rows of terminals due to crowding of the insulated wires. Furthermore, even if a restraining device is installed, it might not be able to engage any features of the terminal for various reasons. For example, the insulated wire may have a larger diameter than some parts of the terminal such that when the device navigates beyond the wire, it might slip past a certain part of the terminal that it was intended to engaged. In addition, different terminal types (e.g., pin or socket), sizes, and orientations provide varying features that a restraining device may engage in order to push and/or retain the terminal in the cavity. For example, the same device may effectively engage a roof of a receptacle terminal, but slip past and fail to engage a pin terminal or even the same receptacle terminal oriented upside down.

A need remains for an electrical connector that assures complete installation of terminals into the cavities of a connector housing to allow a successful electrical connection with a mating connector.

BRIEF DESCRIPTION OF THE INVENTION

In an embodiment, an electrical connector includes a housing, terminals, and a stuffer. The housing has a plurality of terminal channels extending from a rear to a front of the housing. The front of the housing is configured to interface with a mating connector. The terminals are loaded into corresponding terminal channels from the rear of the housing. The terminals extend along a terminal axis between a mating end and a terminating end. The terminating end includes at least one tab that protrudes radially outward from the terminal axis. The stuffer is coupled to the rear of the housing. The stuffer includes multiple teeth received in corresponding terminal channels. When one of the terminals is not fully loaded in the terminal channel, the corresponding tooth engages one or more of the at least one tab of the terminal and forces the terminal further into the terminal channel.

In an embodiment, an electrical connector includes a housing, terminals, and a stuffer. The housing has a plurality of terminal channels extending from a rear to a front of the housing. The front of the housing is configured to interface with a mating connector. The terminals are loaded into corresponding terminal channels from the rear of the housing. The terminals extend along a terminal axis between a mating end and a terminating end. The terminating end includes an insulation crimp barrel terminated to an end of a cable. The insulation crimp barrel has at least one tab that protrudes radially outward from the terminal axis. The stuffer is coupled to the rear of the housing. The stuffer includes multiple teeth received in corresponding terminal channels between the cable and an interior wall of the terminal channel. When one of the terminals is not fully loaded in the terminal channel, the corresponding tooth engages one or more of the at least one tab on the insulation crimp barrel and forces the terminal further into the terminal channel.

In an embodiment, an electrical connector includes a housing, terminals, and two stuffers. The housing has a plurality of terminal channels extending from a rear to a front of the housing. The front of the housing is configured to interface with a mating connector. The terminal channels are aligned in a first row proximate to a top of the housing and a second row proximate to a bottom of the housing. The terminals are loaded into corresponding terminal channels from the rear of the housing. The terminals extend along a terminal axis between a mating end and a terminating end. The terminating ends of the terminals are terminated to ends of corresponding cables. Each terminating end includes at least one tab that protrudes radially outward from the terminal axis. The first stuffer is coupled to the rear of the housing above the cables extending from corresponding terminals in the first row. The second stuffer is coupled to the rear of the housing below the cables extending from corresponding terminals in the second row. The first stuffer includes multiple teeth received in corresponding terminal channels of the first row behind the terminals. The second stuffer includes multiple teeth received in corresponding terminal channels of the second row behind the terminals. When one of the terminals is not fully loaded in the terminal channel, the corresponding tooth of the first or second stuffer engages one or more of the at least one tab of the terminal and forces the terminal further into the terminal channel.

DETAILED DESCRIPTION OF THE INVENTION

One or more embodiments of the inventive subject matter described herein provide electrical connector systems with improved features for assuring correct terminal position within a connector housing.

Figure 1:
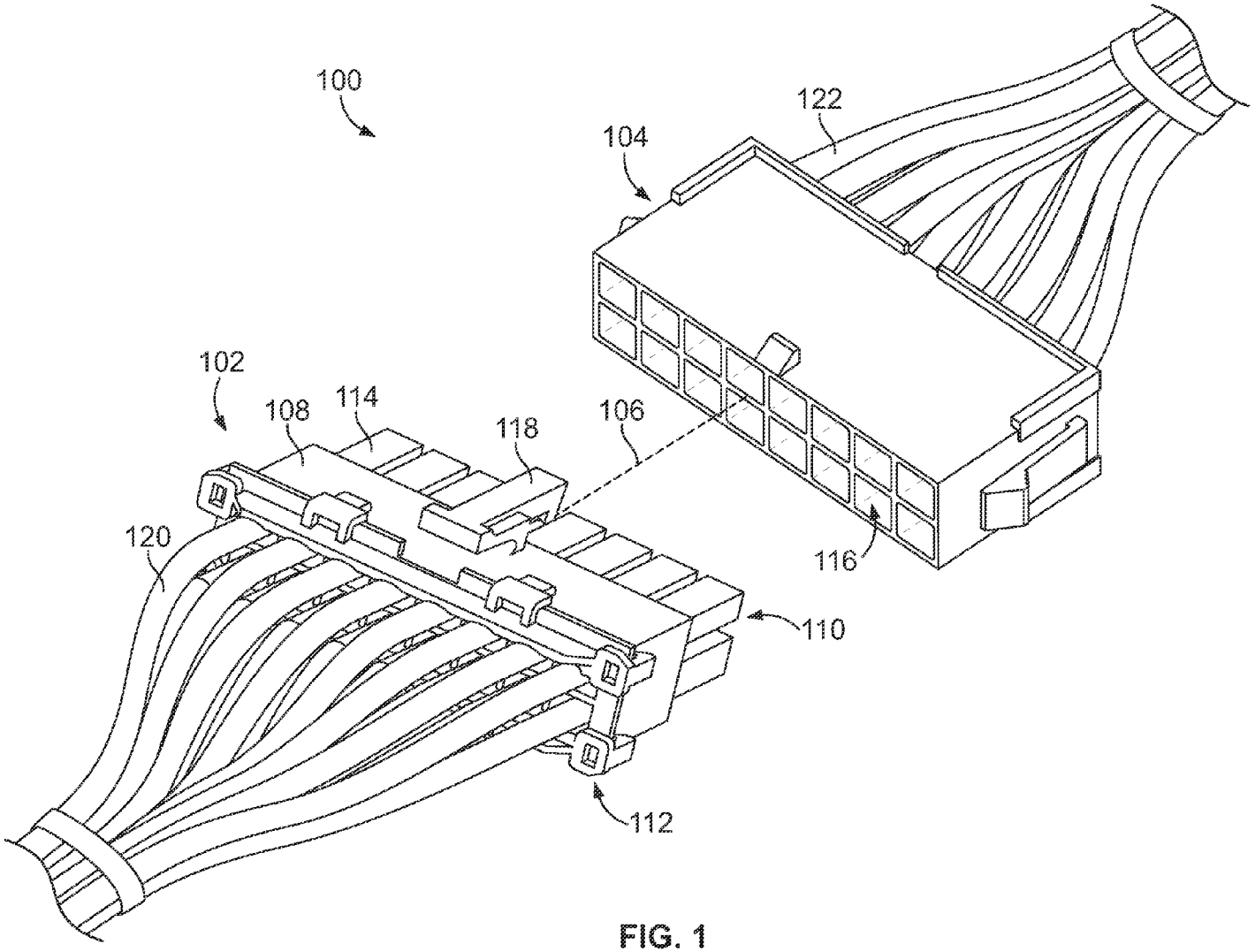
FIG. 1 is a perspective view of an electrical connector system formed in accordance with an exemplary embodiment.

FIG. 1 is a perspective view of an electrical connector system 100 formed in accordance with an exemplary embodiment. The electrical connector system 100 has an electrical connector 102 configured to couple with a mating connector 104. As shown in FIG. 1, the electrical connector 102 is poised for mating with the mating connector 104 along mating axis 106. The electrical connector 102 may be in the form of a receptacle connector, where the mating connector 104 is a plug connector, in order to provide a wire to wire electrical connection. Alternatively, the electrical connector 102 may be a plug connector and the mating connector 104 is a receptacle connector. In an alternative embodiment, the electrical connector 102 or the mating connector 104 may be a header connector that is mounted to a substrate, such as a printed circuit board.

The electrical connector 102 has a housing 108 with a front 110 and a rear 112. The front 110 of the housing 108 is configured to interface with the mating connector 104. For example, the housing 108 may include one or more projections 114 that are received in corresponding openings 116 in the mating connector 104. The housing 108 may also include one or more coupling features 118 that allow the housing 108 to couple to the mating connector 104. For example, the coupling features 118 may include one or more latches, latch-receiving grooves or extensions, bolts, adhesives, and the like.

The housing 108 of the electrical connector 102 may hold a plurality of conductors 120. For example, the housing 108 may be configured to receive between two and twenty-four conductors 120. The housing 108 in the illustrated embodiment includes sixteen conductors 120. The conductors 120 may be configured to physically and electrically connect to corresponding mating conductors 122 of the mating connector 104. The housing 108 at the front 110 may be designed to guide the conductors 120 and 122 into engagement with each other. For example, the front 110 may optionally include chamfered lead-in channels (not shown) that guide the mating conductors 122 into the housing 108.

The conductors 120 may extend from the rear 112 of the housing 108 towards an electrical component (not shown). Optionally, the conductors 120 may be bundled together in a wire harness. The mating conductors 122 also extend toward an electrical component, and the plurality of conductors 120, 122 may be used to transmit power, data, and/or control signals between at least the two electrical components. If a single conductor 120 of the electrical connector 102 fails to correctly engage the corresponding mating conductor 122 of the mating connector 104, the signal path between those two conductors 120, 122 may be damaged. Furthermore, the broken signal path may also disrupt other signal paths along different conductors 120, 122 in the connectors 102, 104, respectively, which could affect the utility of the connector system 100 as a whole.

Figure 2:
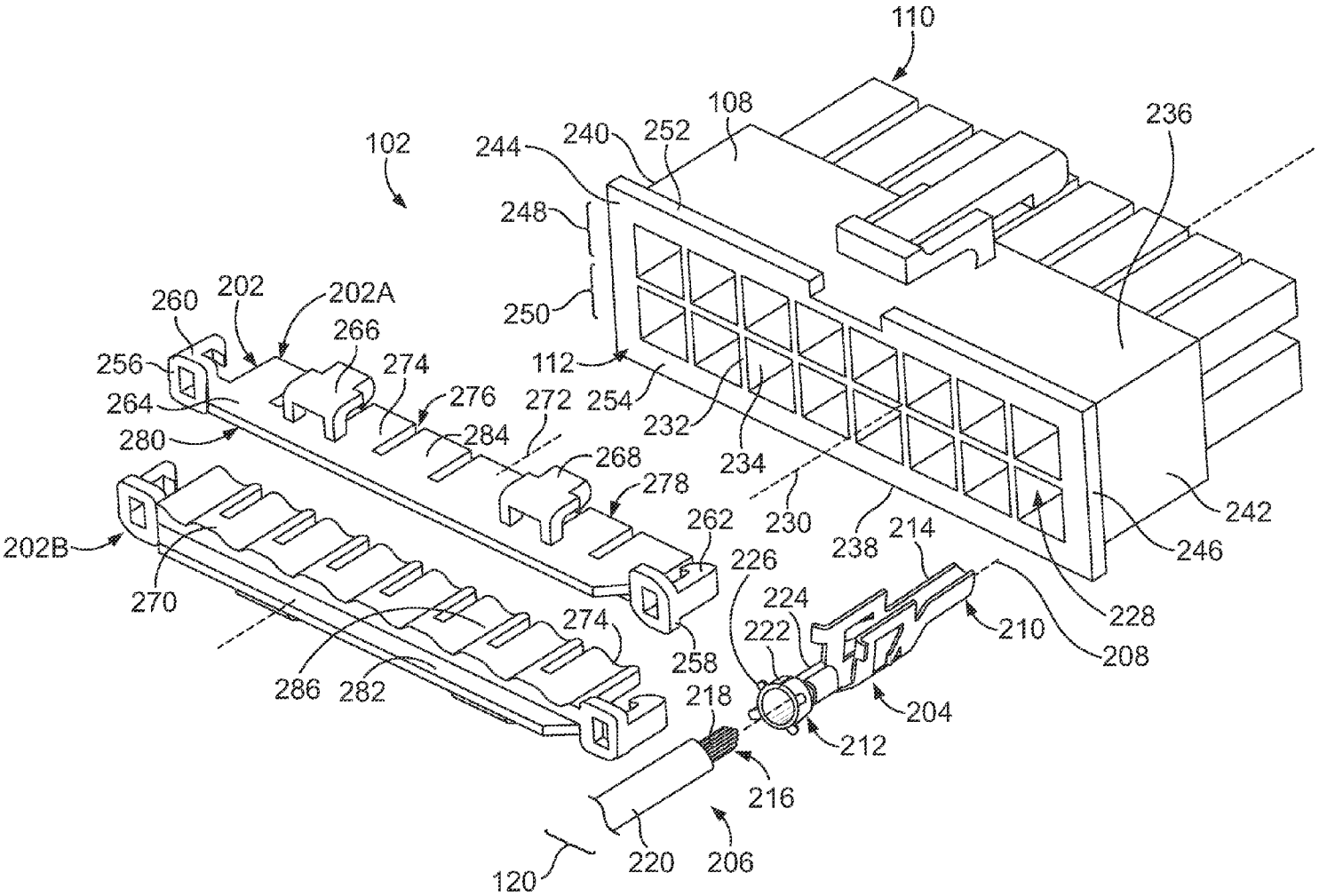
FIG. 2 is an exploded perspective view of an embodiment of an electrical connector of the electrical connector system of FIG. 1.

FIG. 2 is an exploded perspective view of an embodiment of the electrical connector 102 of the electrical connector system 100 shown in FIG. 1. The electrical connector 102 includes the housing 108, one or more of the conductors 120, and at least one stuffer 202. The conductor 120 may include a terminal 204 that is terminated to a cable 206.

The terminal 204 may extend along a terminal axis 208 between a mating end 210 and a terminating end 212. The terminal 204 may be composed of a conductive material, such as a metal (e.g., copper, silver, aluminum, etc.), graphite, a conductive polymer, or the like. In an embodiment, the terminal 204 is formed by stamping and forming a thin sheet of metal into a desired shape using a press or a similar machine.

The mating end 210 is configured to electrically connect to a mating contact (not shown) of the mating conductor 122 (shown in FIG. 2). The mating end 210 may be formed as a pin 214 that is configured to be received in a socket of the mating contact. In an alternative embodiment, the mating end 210 may be formed as a socket that receives a pin of the mating contact. The terminating end 212 of the terminal 204 is configured to couple to the cable 206. For example, the terminating end 212 may be coupled to an end 216 of the cable 206 by crimping, soldering, insulation displacement, and the like. The cable 206 may be one or more wires 218 within an insulated jacket 220. Like the terminal 204, the wire(s) 218 may also be formed of a conductive material, such as copper. The jacket 220 may be composed of a non-conductive, insulator material, such as rubber, plastics, and/or thermoplastic polymers (e.g., polytetrafluoroethylene).

In an exemplary embodiment, the terminating end 212 of the terminal 204 is configured to crimp to the end 216 of the cable 206. For example, the terminating end 212 includes an insulation crimp barrel 222 that is crimped to the jacket 220 and a wire crimp barrel 224 that is crimped to a portion of the wire(s) 218 at the end 216 that emerges from the insulated jacket 220. The insulation crimp barrel 222 may have a cylindrical shape that receives the jacket 220 of the cable 206. Crimping the wire(s) 218 to the wire crimp barrel 224 electrically connects the terminal 204 to the cable 206. Crimping the insulation crimp barrel 222 around the jacket 220 physically couples the terminal 204 to the cable 206, such that push-pull forces between the terminal 204 and the cable 206 are absorbed by the insulation crimp barrel 222 to relieve stress on the wire(s) 218 in the wire crimp barrel 224.

In an exemplary embodiment, the terminating end 212 of the terminal 204 includes at least one tab 226 that protrudes radially outward from the terminal axis 208. The at least one tab 226 may be integrally formed in the terminal 204. For example, when the terminal 204 is formed, the at least one tab 226 may be bent radially outward from the terminal axis 208. The terminating end 212 may have multiple tabs 226 that are dispersed around a perimeter of the terminating end 212. Optionally, the tabs 226 may be evenly spaced along the perimeter. In the illustrated embodiment, the terminating end 212 may have four tabs 226 that are evenly dispersed around the circumference of the insulation crimp barrel 222 at the terminating end 212. Optionally, the terminating end 212 may have more or less than four tabs 226. In an alternative embodiment, the terminating end 212 may have only a single tab 226 that extends around at least most of the perimeter of the terminating end 212, such as around the entire perimeter. The at least one tab 226 may be located at the rear-most point of the terminating end 212 of the terminal 204. For example, the at least one tab may be disposed on the insulation crimp barrel 222, which is the rear-most portion of the terminating end 212.

The housing 108 includes multiple terminal channels 228 that are configured to receive the terminals 204 therein. The terminal channels 228 may extend from the rear 112 to the front 110 of the housing 108. The terminal channels 228 may be oriented between the rear 112 and the front 110 of the housing 108 parallel to each other along a terminal channel axis 230. Adjacent terminal channels 228 may be separated by ribs 232. Within the channels 228, the ribs 232 define interior walls 234. The terminal channels 228 may be aligned in rows and/or columns.

The housing 108 has a top 236, a bottom 238, a first side 240, and a second side 242 (e.g., which may be opposite to the first side 240) that extend between the front 110 and the rear 112. In an exemplary embodiment, the first and second sides 240, 242 include respective first and second ledges 244, 246. The ledges 244, 246 extend outward from the planes defined by the sides 240, 242, respectively. In an embodiment, the ledges 244, 246 are proximate to the rear 112 of the housing 108, such as at the interface between the respective sides 240, 242 and the rear 112. The ledges 244, 246 span at least partially the height between the top 236 and the bottom 238 of the housing 108. Optionally, the housing 108 may also include a top ledge 252 along the top 236 of the housing 108 and/or a bottom ledge 254 along the bottom 238 of the housing 108. Like the side ledges 244, 246, the top and bottom ledges 252, 254 may be proximate to the rear 112 and/or may extend at least partially along the length of the housing 108 between the first and second sides 240, 242.

In an exemplary embodiment, the terminal channels 228 are arranged in at least two rows 248, 250 between the first and second sides 240, 242. The first row 248 is proximate to the top 236 of the housing 108, and the second row 250 is proximate to the bottom 238. Each of the rows 248, 250 may have one or more terminal channels 228, such as between one and twelve channels 228. In the illustrated embodiment, each of the rows 248, 250 includes eight channels 228, for a total of sixteen in the housing 108.

The stuffer 202 has a first side 256 and a second side 258. In an exemplary embodiment, the stuffer 202 includes a coupling mechanism on each of the sides 256, 258 to allow the stuffer to be coupled to the housing 108. For example, the stuffer 202 may include a first latch 260 on the first side 256 and a second latch 262 on the second side 258. The first and second latches 260, 262 are configured to be coupled to the respective first and second side ledges 244, 246 of the housing 108 to mount the stuffer 202 to the housing 108. In an alternative embodiment, the housing 108 may have side latches, and the stuffer 202 may have ledges or other projections that couple to the latches of the housing 108 to mount the stuffer 202 to the housing 108.

In an exemplary embodiment, the electrical connector 102 includes two stuffers 202A and 202B. The stuffers 202A, 202B may have identical (e.g., if not significantly similar) shapes. The stuffers 202A, 202B may be formed by the same process to produce the identical shapes. For example, the stuffers 202A, 202B may be both molded using the same dies. The stuffers 202A, 202B may be composed of a non-conductive, insulator material, such as rubber, plastic, and/or a thermoplastic polymer. In the illustrated embodiment, the stuffer 202B has the same shape as the stuffer 202A, but is shown rotated 180° from the stuffer 202A along an axis 272. Since the stuffers 202A, 202B may be identical, the shared features may be described in reference to a singular stuffer 202.

The stuffer 202 includes a first end 264 that extends the length of the stuffer 202 between the first and second sides 256, 258. Optionally, one or more other coupling mechanisms may be disposed along the first end 264. For example, the stuffer 202 may have a third latch 266 located along the first end 264. The third latch 266 may be configured to couple to the top ledge 252 and/or the bottom ledge 254, depending on the placement and orientation of the stuffer 202 relative to the housing 108. In the illustrated embodiment, the stuffer 202 also includes a fourth latch 268 along the first end 264 that is spaced apart from the third latch 266.

The stuffer 202 also includes a second end 270 that is opposite the first end 264. In an embodiment, the stuffer 202 does not have any coupling mechanisms (e.g., latches, hooks, etc.) on the second end 270. The stuffer 202 has a plurality of teeth 274. The teeth 274 may be disposed along at least some of the length between the first and second sides 256, 258, and the teeth 274 are separated by slots 276. The slots 276 may extend from the front 278 of the stuffer 202 at least part of the width of the stuffer 202 (e.g., between the front 278 and a rear 280 of the stuffer 202). In an embodiment, the teeth 274 are aligned in a single row across the length of the stuffer 202. Although the same teeth 274 may surfaces on both the first end 264 and the second end 270 of the stuffer 202, the two surfaces may not be the same. In an exemplary embodiment, the teeth 274 have a flat, planar surface 284 along the first end 264, but a cupped surface 286 along the second end 270. The cupped surface 286 may have a scooped or bowed-downward shape with a concave cross-section that extends the length of each tooth 274. The cupped surface 286 is configured to accommodate (e.g., provide space for) the cable 206 of the conductor 120 when the electrical connector 102 is assembled, as discussed below. Optionally, the stuffer 202 may include a shelf 282 that is located rearward of the teeth 274. The shelf 282 extends at least part of the length of the stuffer 202, and is configured to provide a component that allows a user to hold onto when handling the stuffer 202 during assembly and/or disassembly of the electrical connector 102.

Figure 3:
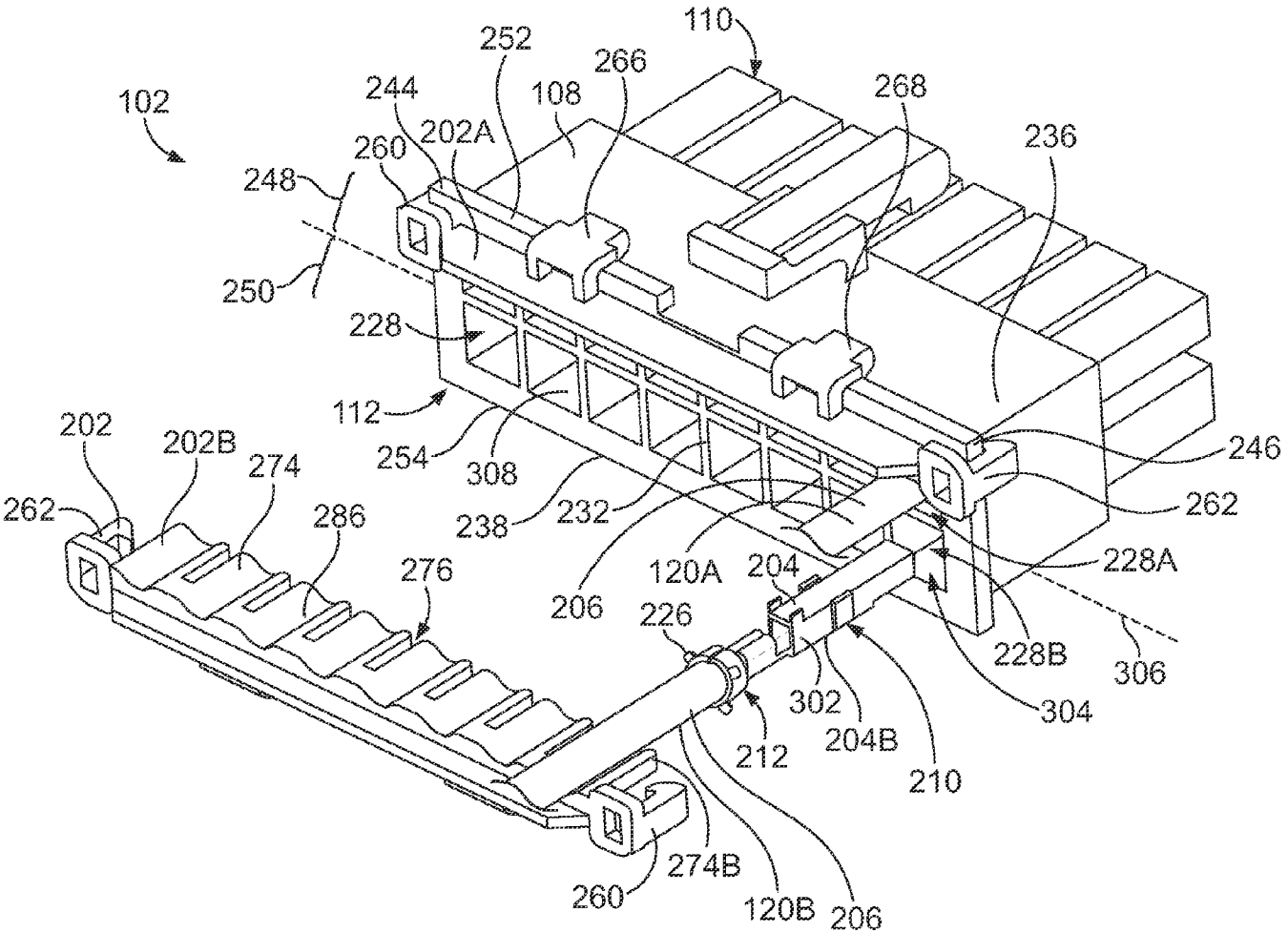
FIG. 3 is a partially-exploded perspective view of an embodiment of an electrical connector of the electrical connector system of FIG. 1.

FIG. 3 is a partially-exploded perspective view of an embodiment of the electrical connector 102 of the electrical connector system 100 shown in FIG. 1. For example, FIG. 3 may show the assembly of the electrical connector 102. The electrical connector 102 is partially assembled, as a first conductor 120A and first stuffer 202A are assembled to the housing 108, while a second conductor 120B and second stuffer 202B are poised for assembly to the housing 108. Although only two conductors 120A, 102B are shown in FIG. 3, the housing 108 may be configured to hold more conductors 120.

The terminals 204 of the conductors 120 are configured to be loaded into corresponding terminal channels 228 of the housing 108. For example, each terminal channel 228 may receive at most one terminal 204. The terminal 204B is poised for loading into terminal channel 228B. The terminal 204B is shown in FIG. 3 as a socket terminal having a socket 302 at the mating end 210, although optionally or alternatively at least some of the terminals 204 may be pin-type terminals having a pin 214 (shown in FIG. 2). The terminals 204 are loaded into the corresponding terminal channels 228 from the rear 112 of the housing 108. The terminals are received through a rear opening 304 of the terminal channels 228 and advanced towards the front 110 of the housing 108 until reaching a fully loaded position. At the fully loaded position, the terminal 204 is in a correct position for engaging the corresponding mating contact (not shown) of the mating connector 104 (shown in FIG. 1). The terminal 204B of conductor 102B has not been loaded into the terminal channel 228B, and, therefore, is not in the fully loaded position. However, the terminal (not shown) of the conductor 120A may be fully loaded within the corresponding terminal channel 228A.

In an exemplary embodiment, when the terminals 204 are loaded into the terminal channels 228, the entire length of the terminal 204 is received into the terminal channel 228 beyond the rear opening 304. For example, the one or more tabs 226, located at the terminating end 212 of the terminal 204, are received through the rear opening 304 and into the channel 228. The cable 206 terminated to the terminating end 212 of the terminal 204 extends rearward from the interior of the terminal channel 228, across the rear opening 304, and out of the rear 112 of the housing 108.

The stuffer 202 is configured to be coupled to the rear 112 of the housing 108. As shown in FIG. 3, the first stuffer 202A is already coupled to the housing 108, while the second stuffer 202B is poised for coupling to the housing 108. In an exemplary embodiment, the first stuffer 202A is coupled proximate to the top 236 of the housing 108, and the second stuffer 202B is poised for coupling proximate to the bottom 238. The first and second latches 260, 262 of the first stuffer 202A are coupled to the first and second side ledges 244, 246, respectively. In the illustrated embodiment, the third and fourth latches 266, 268 are each coupled to the top ledge 252 to provide additional coupling support along the length of the stuffer 202A. In an alternative embodiment, for electrical connectors having a relatively fewer amount of terminal channels in each row (e.g., six or less), the stuffer need not have any latches or other coupling mechanisms between the two side latches due to the shorter length of the stuffer.

In an exemplary embodiment, when the second stuffer 202B is coupled to the housing 108 proximate to the bottom 238, the first and second stuffers 202A, 202B are oriented such that they mirror each other across a row axis 306 (e.g., defined by or parallel to at least one of the terminal rows 248, 250). For example, the second stuffer 202B is flipped relative to the first stuffer 202A such that the first latch 260 of the second stuffer couples to the second side ledge 246 of the housing 108 and the second latch 262 couples to the first side ledge 244, which is opposite of the first stuffer 202A. Although not shown in FIG. 3, the third and fourth latches 266, 268 of the second stuffer 202B couple to the bottom ledge 254 of the housing 108.

The teeth 274 of the stuffer 202 are received in corresponding terminal channels 228. For example, when the stuffer 202 is coupled to the rear 112 of the housing 108, the ribs 232 that define and separate the terminal channels 228 are received in the slots 276 between the individual teeth 274, and each tooth 274 enters a single terminal channel 228. Optionally, the terminal channels 228 may be at least slightly wider than the teeth 274 to allow for easy assembly and disassembly of the stuffer 202 to and from the housing 108. In an exemplary embodiment having two stuffers 202A, 202B, the first stuffer 202A is coupled along the first or top row 248, so the respective teeth (not shown) enter the terminal channels 228A of the first row 248. Likewise, the second stuffer 202B couples along the second or bottom row 250, so the respective teeth 274B enter the terminal channels 228B of the second row 250.

The teeth 274 may be received in the corresponding terminal channels 228 between the cable 206 extending from the terminal 204 and an interior wall of the terminal channel 228. The interior wall may be a top interior wall 410 (shown in FIG. 4) that is adjacent to the top 236 and/or a bottom interior wall 308 that is adjacent to the bottom 238 of the housing 108. For example, teeth 274 of the first stuffer 202A may be received between the cable 206 of the first conductor 120A and the top interior wall 410 of the terminal channels 228A, where the top interior wall 410 is adjacent to the top 236 of the housing 108. On the other hand, the teeth 274 of the second stuffer 202B may be received between the cable 206 of the second conductor 120B and the bottom interior wall 308 of the terminal channels 228B, where the bottom interior wall 308 is adjacent to the bottom 238 of the housing 108. The cupped surface 286 of the teeth 274 accommodates the corresponding cable 206 that extends from the terminating end 212 of the terminal 204. As shown in FIG. 3, the cupped surface 286 may be cupped to receive and at least partially surround the cable 206 around the circumference of the cable 206. The planar surface 284 (shown in FIG. 3) of the teeth 274 along the other end 264 (shown in FIG. 2) may interface with a planar surface of the top and/or bottom interior wall 410, 308.

In an exemplary embodiment, the stuffer 202 may be a terminal position assurance device. The stuffer 202 couples to the rear 112 of the housing 108 to restrict the terminals 204 from being forced, unintentionally, rearward out of the fully loaded position and/or out of the corresponding terminal channels 228. In addition, when one of the terminals 204 is not fully loaded in the corresponding terminal channel 228, the stuffer 202 may be configured to force the terminal 204 further into the terminal channel 228 towards and/or to the fully loaded position. For example, the corresponding tooth 274 may engage one or more of the tabs 226 of the terminal 204 that is not fully loaded when the stuffer 202 is being coupled to the housing 108, and as the tooth 274 advances into the corresponding terminal channel 228, the tooth 274 forces the terminal 204 (e.g., via the tab 226) further into the terminal channel 228.

Figure 4:
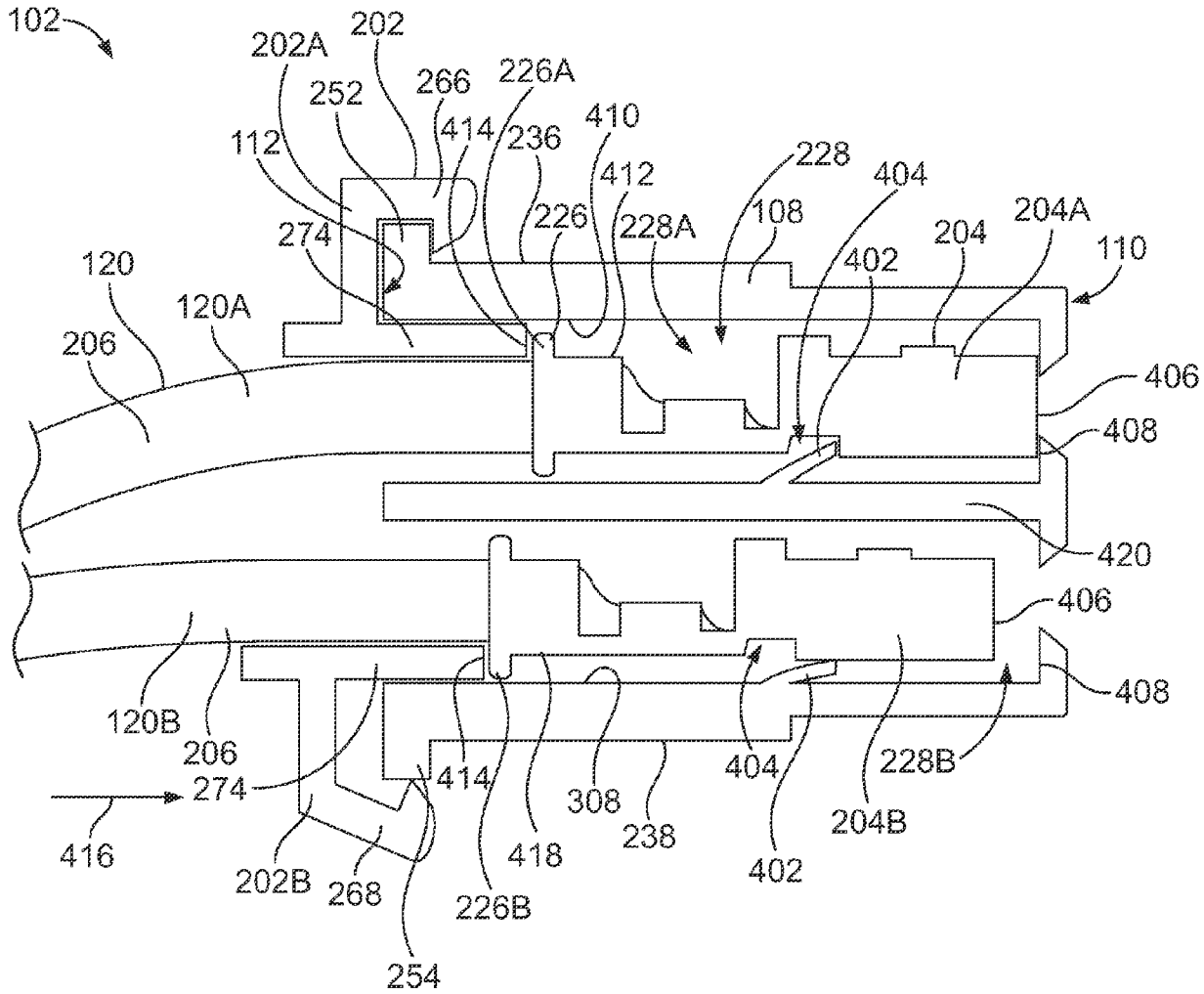
FIG. 4 is a cross-section of an embodiment of an electrical connector of the electrical connector system of FIG. 1.

FIG. 4 is a cross-section of an embodiment of the electrical connector 102 of the electrical connector system 100 shown in FIG. 1. In FIG. 4, two conductors 120A, 120B are at least partially loaded in respective terminal channels 228A, 228B. Channel 228A is adjacent to the top 236 of the housing 108, while channel 228B is adjacent to the bottom 238. The terminal 204A of the top conductor 120A is fully loaded in the terminal channel 228A such that the terminal 204A is in the fully loaded position. For example, the fully loaded position may be achieved when a biased retention finger 402 within the channel 228 is received in a groove 404 in the terminal 204. Optionally, the terminal 204 may have a retention finger that is received in a groove in an interior wall of the channel 228 when the terminal 204 is fully loaded. Additionally, or in the alternative, the terminal 204 may reach the fully loaded position when a front end 406 of the terminal 204 contacts a restraining wall 408 at the front 110 of the housing 108.

As shown in FIG. 4, the stuffer 202A is coupled to the rear 112 of the housing 108, such that the top latch 266 is fully engaged with the top ledge 252. The corresponding tooth 274 of the stuffer 202A is received in the terminal channel 228A between the cable 206 of the top conductor 120A and a top interior wall 410 of the terminal channel 228A. The tooth 274 is positioned behind (e.g., rearward of) one or more tabs 226 of the terminal 204A.

The tooth 274 may be configured to engage the tab(s) 226, such as to force the terminal 204A further into the terminal channel 228A and/or to block rearward movement of the terminal 204A in the channel 228A. In an embodiment, distal ends 414 of the teeth 274 of the top stuffer 202A may be configured to engage one or more tabs 226A that are located on and/or near the top 412 of the terminals 204 that are in the terminal channels 228 of the top row 248 (shown in FIG. 3). The top tabs 226A need not be located at the top-most point of the terminal 204A, since the teeth 274 are cupped in order to wrap at least partly around the cable 206, so the tooth 274 would engage tabs 226 that are at least near the top 412 of the terminal 204A. Optionally, since the terminal 204A is fully loaded in the channel 228A, the tooth 274 shown in FIG. 4 may not engage the tab 226A unless and until the terminal 204A is forced rearward out of the fully loaded position and the tab 226A contacts the tooth 274 of the stationary stuffer 202A. If, however, the top terminal 204A is not fully loaded prior to coupling the stuffer 202A to the housing 108, the distal end 414 of the corresponding tooth 274 engages the one or more top tabs 226A to force the terminal 204A further into the channel 228A towards the fully loaded position.

As shown in FIG. 4, the lower terminal 204B is not fully loaded within the corresponding channel 228B. The terminal 204B is rearward of the terminal 204A, the front end 406 is not proximate to the restraining wall 408, and retention finger 402 is not received in the groove 404 of the terminal 204B. At the current position, a mating contact (not shown) that engages the terminal 204B may force the terminal 204B rearward, and the electrical connection may be damaged or lost.

In an exemplary embodiment, the stuffer 202B is coupled to the rear 112 of the housing 108 in the coupling direction 416. The stuffers 202 are configured to assure that all terminals 204 reach the fully loaded position within the corresponding terminal channels 228, and to assure that the terminals 204 are retained in the fully loaded position during use of the electrical connector 102. As the lower stuffer 202B is advanced in the direction 416, the latch 268 is deflected by the bottom ledge 254 of the housing 108. In addition, the corresponding tooth 274 of the stuffer 202B enters the channel 228B behind the terminal 204B and engages at least one tab 226 of the terminal 204B. For example, the tooth 274 of stuffer 202B may be received in the terminal channel 228B between the cable 206 of the lower second conductor 120B and the bottom interior wall 308 of the terminal channel 228B. Since the terminal 204B is not fully loaded, the distal end 414 of the tooth 274 engages one or more tabs 226B that are located on and/or near the bottom 418 of the terminal 204B. In general, the teeth 274 of the stuffer 202B may be configured to engage lower or bottom tabs 226B of any non-fully loaded terminals 204 that are in the bottom row 250 (shown in FIG. 3) of terminal channels 228. The lower tabs 226B need not be located at the bottom-most point of the terminal 204B, since the teeth 274 are cupped in order to wrap at least partly around the cable 206, so the tooth 274 would engage tabs 226 that are at least near the bottom 418 of the terminal 204B. The stuffers 202 are configured such that, when the latch 268 of the stuffer 202B couples to the bottom ledge 254, the tooth 274 will have advanced the tab 226B far enough in the direction 416 that the terminal 204B reaches the fully loaded position in the channel 228B.

In an exemplary embodiment, the stuffer 202 and terminal 204 may be configured such that the corresponding tooth 274 would contact at least one tab 226 of a non-fully loaded terminal 204 regardless of how the terminal 204 is rotated within the terminal channel 228. For example, the one or more tabs 226 of the terminals 204 may extend from or near the top 412 of the terminal 204 as well as from or near the bottom 418 of the terminal 204, so a corresponding tooth 274 of a stuffer 202 would engage the tabs 226 regardless of whether the tooth 274 is located below or above the cable 206 terminated to the terminal 204. In addition, as shown in FIG. 4, the clearance between the tabs 226 and interior walls 410, 308 of the channels 228 may be relatively narrow (e.g., relative to the thickness of the tooth 274) to prevent the possibility that a tooth 274 extends past the tabs 226 without engaging one or more of the tabs 226. In such hypothetical case, the stuffer 202 would fail at its function of providing terminal position assurance since the terminal would be able to move relative to the corresponding tooth 274.

In an exemplary embodiment, the stuffers 202A, 202B are respectively located above and below the conductors 120. For example, the teeth 274 of the top stuffer 202A are above both conductors 120A and 120B, and the teeth 274 of the bottom stuffer 202B are below both conductors 120A and 120B. Such positions allow the stuffers 202 to be coupled and removed from the housing 108 with little difficulty and/or interference due to the plurality of cables 206 that extend rearward of the housing 108. For example, neither of the stuffers 202A or 202B extend between the conductors 120A, 120B along the center rib 420 that divides the top channel 228A from the bottom channel 228B. Due to the plurality of wires in the area, it would be difficult to install a stuffer between two rows of terminal channels, and also difficult to later remove the stuffer. The two stuffers 202A, 202B located respectively above and below the conductors 120 avoids the problem of trying to fit a stuffer between two rows of terminal channels.

In an alternative embodiment, instead of installing two individual stuffers 202A, 202B, an electrical connector may have a single stuffer that is comparable to the functionality provided by the two stuffers 202A, 202B. For example, the two stuffers 202A, 202B may be joined on at least one side by an arm such that the resulting single stuffer is "C"-shaped (e.g., if joined at one side) or box-shaped (e.g., if joined at both sides). The connecting arm(s) may be integrally formed with the stuffer during the manufacturing process to produce the alternative stuffers. Whether the alternative single stuffer is C-shaped or a fully-closed box-shape, the corresponding teeth may still be configured such that the teeth enter the corresponding channels above the cables of conductors in a top row and below the cables of conductors in a bottom row (e.g., so as to avoid the spacing problem between the rows).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a plurality of terminal channels extending from a rear to a front of the housing, the front of the housing configured to interface with a mating connector;

terminals loaded into corresponding terminal channels from the rear of the housing, the terminals extending along a terminal axis between a mating end and a terminating end, the terminating end including at least one tab that protrudes radially outward from the terminal axis; and a stuffer coupled to the rear of the housing, the stuffer including multiple teeth received in corresponding terminal channels, wherein, when one of the terminals is not fully loaded in the terminal channel, the corresponding tooth engages one or more of the at least one tab of the terminal and forces the terminal further into the terminal channel.

2. The electrical connector of claim 1, wherein the at least one tab is provided at the rear-most portion of the terminating end.

3. The electrical connector of claim 1, wherein the terminating end includes an insulation crimp barrel configured to be crimped to an end of a cable.

4. The electrical connector of claim 1, wherein the terminals have a plurality of tabs at the terminating end, the corresponding tooth of the stuffer engaging at least two of the tabs of the one terminal that is not fully loaded in the terminal channel.

5. The electrical connector of claim 1, wherein the stuffer includes a first latch on a first side of the stuffer and a second latch on an opposite second side of the stuffer, the first and second latches coupled to corresponding first and second side ledges that extend along respective first and second sides of the housing.

6. The electrical connector of claim 5, wherein the stuffer includes a third latch along a first end of the stuffer between the first and second sides, the third latch coupled to at least one of a top ledge or a bottom ledge of the housing.

7. The electrical connector of claim 1, wherein the terminal channels are aligned in a first row and a second row, the stuffer defining a first stuffer coupled to the housing such that the respective teeth enter the terminal channels of the first row, and the electrical connector further comprising a second stuffer coupled to the housing such that the respective teeth enter the terminal channels of the second row.

8. The electrical connector of claim 7, wherein the first and second stuffers are identical and are oriented on the rear of the housing such that the first stuffer mirrors the second stuffer across a row axis.

9. The electrical connector of claim 7, wherein the first row is proximate to a top of the housing and the second row is proximate to a bottom of the housing, the teeth of the first stuffer positioned behind one or more top tabs of the terminals, and the teeth of the second stuffer positioned behind one or more bottom tabs of the terminals.

10. The electrical connector of claim 9, the first stuffer is positioned above cables extending from corresponding terminals in the first row and the second stuffer is positioned below cables extending from corresponding terminals in the second row such that the cables are located between the first and second stuffers.

11. The electrical connector of claim 1, wherein the terminating end of the terminal includes a plurality of tabs that are evenly dispersed along a perimeter of the terminating end.

12. The electrical connector of claim 1, wherein the teeth of the stuffer each have a cupped surface to accommodate a cable extending from the corresponding terminal when the teeth are received in the terminal channels.

13. The electrical connector of claim 1, wherein the at least one tab of the terminal is configured to be received through a rear opening of the terminal channel with a clearance between the at least one tab and an interior wall of the terminal channel that prevents the corresponding tooth of the stuffer from extending past the at least one tab along the interior wall.

14. An electrical connector comprising:

a housing having a plurality of terminal channels extending from a rear to a front of the housing, the front of the housing configured to interface with a mating connector;

terminals loaded into corresponding terminal channels from the rear of the housing, the terminals extending along a terminal axis between a mating end and a terminating end, the terminating end including an insulation crimp barrel terminated to an end of a cable, the insulation crimp barrel having at least one tab that protrudes radially outward from the terminal axis; and a stuffer coupled to the rear of the housing, the stuffer including multiple teeth received in corresponding terminal channels between the cable and an interior wall of the terminal channel, wherein, when one of the terminals is not fully loaded in the terminal channel, the corresponding tooth engages one or more of the at least one tab on the insulation crimp barrel and forces the terminal further into the terminal channel.

15. The electrical connector of claim 14, wherein each tooth of the stuffer has a cupped surface that faces the cable within the corresponding terminal channel to accommodate the cable.

16. The electrical connector of claim 14, wherein the terminals include a plurality of tabs that are dispersed along a perimeter of the insulation crimp barrel at the rear-most portion of the insulation crimp barrel.

17. The electrical connector of claim 14, wherein the interior wall is a top interior wall when the corresponding terminal channel is proximate to a top of the housing and the interior wall is a bottom interior wall when the corresponding terminal channel is proximate to a bottom of the housing.

18. An electrical connector comprising:

a housing having a plurality of terminal channels extending from a rear to a front of the housing, the front of the housing configured to interface with a mating connector, the terminal channels aligned in a first row proximate to a top of the housing and a second row proximate to a bottom of the housing;

terminals loaded into corresponding terminal channels from the rear of the housing, the terminals extending along a terminal axis between a mating end and a terminating end, the terminating ends of the terminals terminated to corresponding cables and each terminating end including at least one tab that protrudes radially outward from the terminal axis; and a first stuffer coupled to the rear of the housing above the cables extending from corresponding terminals in the first row and a second stuffer coupled to the rear of the housing below the cables extending from corresponding terminals in the second row, the first stuffer including multiple teeth received in corresponding terminal channels of the first row behind the terminals and the second stuffer including multiple teeth received in corresponding terminal channels of the second row behind the terminals, wherein, when one of the terminals is not fully loaded in the terminal channel, the corresponding tooth of the first or second stuffer engages one or more of the at least one tab of the terminal and forces the terminal further into the terminal channel.

19. The electrical connector of claim 18, wherein the teeth of the first stuffer extend between the cable and a top interior wall of the corresponding terminal channels of the first row, and the teeth of the second stuffer extend between the cable and a bottom interior wall of the corresponding terminal channels of the second row.

20. The electrical connector of claim 18, wherein the at least one tab is located at a rear-most point of the terminating end of the terminals.

* * * * *